US008541931B2

(12) United States Patent
Yang

(10) Patent No.: US 8,541,931 B2
(45) Date of Patent: Sep. 24, 2013

(54) LED BASED LAMP INCLUDING REFLECTIVE HOOD TO REDUCE VARIATION IN ILLUMINANCE

(75) Inventor: Haitao Yang, San Jose, CA (US)

(73) Assignee: Intematix Corporation, Fremont, CA (US)

( * ) Notice: Subject to any disclaimer, the term of this patent is extended or adjusted under 35 U.S.C. 154(b) by 311 days.

(21) Appl. No.: 12/721,311

(22) Filed: Mar. 10, 2010

(65) Prior Publication Data

US 2010/0237760 A1 Sep. 23, 2010

Related U.S. Application Data

(60) Provisional application No. 61/160,952, filed on Mar. 17, 2009.

(51) Int. Cl.

| | |
|---|---|
| ***H01J 1/02*** | (2006.01) |
| ***H01J 7/24*** | (2006.01) |
| ***H01J 5/16*** | (2006.01) |

(52) U.S. Cl.

USPC ..... 313/46; 313/11; 313/47; 313/113; 313/110

(58) Field of Classification Search

None

See application file for complete search history.

(56) References Cited

U.S. PATENT DOCUMENTS

| | | | | |
|---|---|---|---|---|
| 5,998,925 | A | 12/1999 | Shimizu et al. | |
| 7,311,858 | B2 | 12/2007 | Wang et al. | |
| 7,390,437 | B2 | 6/2008 | Dong et al. | |
| 7,541,728 | B2 * | 6/2009 | Wang et al. | 313/485 |
| 7,575,697 | B2 | 8/2009 | Li et al. | |
| 7,601,276 | B2 | 10/2009 | Li et al. | |
| 7,648,650 | B2 * | 1/2010 | Liu et al. | 252/301.4 F |
| 7,655,156 | B2 | 2/2010 | Cheng et al. | |
| 8,143,769 | B2 * | 3/2012 | Li | 313/46 |
| 8,274,215 | B2 * | 9/2012 | Liu et al. | 313/504 |
| 8,390,193 | B2 * | 3/2013 | Li et al. | 313/512 |
| 2008/0111472 | A1 | 5/2008 | Liu et al. | |
| 2010/0060130 | A1 * | 3/2010 | Li | 313/46 |
| 2010/0164346 | A1 * | 7/2010 | Li et al. | 313/46 |
| 2010/0308712 | A1 | 12/2010 | Liu et al. | |
| 2011/0215696 | A1 * | 9/2011 | Tong et al. | 313/46 |

* cited by examiner

*Primary Examiner* — Natalie Walford

(74) *Attorney, Agent, or Firm* — Vista IP Law Group, LLP

(57) ABSTRACT

A lamp comprises: a thermally conductive body; a plurality of LEDs configured as an array and mounted in thermal communication with the body and a light reflective hood located in front of the plane of light emitting diodes. The hood has at least two frustoconical light reflective surfaces that surround the array of LEDs and are configured such that in operation light emitted by the lamp is within a selected emission angle (beam spread). The hood is configured such that in operation a variation in illuminance (luminous flux per unit area incident on a surface) is 10% or less over approximately a third to one half of the selected emission angle.

25 Claims, 6 Drawing Sheets

LED BASED LAMP INCLUDING REFLECTIVE HOOD TO REDUCE VARIATION IN ILLUMINANCE

CROSS-REFERENCE TO RELATED APPLICATIONS

This application claims the benefit of U.S. Provisional Application No. 61/160,952, filed Mar. 17, 2009, the contents of which are incorporated herein by reference.

BACKGROUND OF THE INVENTION

1. Field of the Invention

This invention relates to an LED (Light Emitting Diode) based lamp and in particular, although not exclusively, to such a lamp that can be used as a direct replacement for a filament (incandescent) lamp in a recessed lighting fixture such as a ceiling mountable downlight.

2. Description of the Related Art

White light emitting LEDs ("white LEDs") are known in the art and are a relatively recent innovation. It was not until LEDs emitting in the blue/ultraviolet part of the electromagnetic spectrum were developed that it became practical to develop white light sources based on LEDs. As taught, for example in U.S. Pat. No. 5,998,925, white LEDs include one or more phosphor materials, that is photo-luminescent materials, which absorb a portion of the radiation emitted by the LED and re-emit radiation of a different color (wavelength). Typically, the LED chip generates blue light and the phosphor material(s) absorbs a percentage of the blue light and re-emits yellow light or a combination of green and red light, green and yellow light or yellow and red light. The portion of the blue light generated by the LED that is not absorbed by the phosphor material combined with the light emitted by the phosphor material provides light which appears to the human eye as being nearly white in color.

Currently there is a lot of interest in using high brightness white LEDs to replace conventional incandescent light bulbs, halogen reflector lamps and fluorescent lamps. Most lighting devices utilizing high brightness white LEDs comprise arrangements in which a plurality of LEDs replaces the conventional light source component and utilize the existing optical components such as a reflector and/or a lens. Ideally a lamp for a downlight would generate an illuminance (luminous flux (power) per unit area incident on a surface) that was substantially uniform across the lamp's emission angle (beam spread). However, as light emission from a lamp is confined within a selected emission angle this can result in a greater proportion of the light emission being concentrated on the axis thereby further reducing illuminance uniformity within the emission angle. Unlike a filament lamp which closely approximates to a point source, LED based lamps generates light which is often far from point source in character requiring the development of new optical arrangements for LED lamps for general lighting applications. A need exists for an LED based lamp with a selected emission angle and whose illuminance is more uniform than the known lamps.

SUMMARY OF THE INVENTION

According to the invention a lamp comprises: a thermally conductive body; a plurality of light emitting diodes (LEDs) configured as an array and mounted in thermal communication with the body; and a light reflective hood located in front of the plane of LEDs, wherein the hood has at least two frustoconical (i.e. a cone whose apex is truncated by a plane that is parallel to the base) light reflective surfaces that surround the array of LEDs and are configured such that in operation light emitted by the lamp is within a selected emission angle. Typically, the at least two light reflective surfaces are contiguous (conjoint). The hood is configured such that the frustoconical light reflective surfaces direct a proportion of the emitted light away from the emission axis of the lamp to thereby result in the illuminance (luminous flux per unit area incident on a surface) being substantially constant over a larger proportion of the selected emission angle. For example for an LED lamp with a selected emission angle (i.e. angle of divergence from a central axis) of 60° a variation in illuminance of 10% or less can be achieved over an angle of 20°; that is approximately a third of the total selected emission angle. For comparison a lamp without the light reflective hood typically has a variation in illuminance of order 10% over an angle of 10°. It is envisaged that by appropriate configuration of the hood a variation of 10% or less should be achievable over approximately 50% of the total selected emission angle.

Preferably the hood is configured such that in operation a proportion of total light emission emitted within the selected emission angle is at least 90%, preferably at least 95% and more preferably at least 98%.

To enhance the uniformity of light emission intensity the lamp can further comprise a light diffuser, such as a light transmissive window with a surface texturing (e.g. micro surface patterning or topology) that is interposed between the array of LEDs and the hood. Alternatively, the diffuser can comprise a partially light transmissive window such as a light transmissive plastics material which incorporates light scattering particles distributed throughout its volume. In yet a further arrangement the light diffuser can comprise a lens structure such as a Fresnel lens that is configured to direct the light emission in a particular direction. In such an arrangement the lens structure is configured in conjunction with the hood such the lamp produces a more uniform illuminance.

The hood can comprise a generally cylindrical shell with the at least two frustoconical light reflective surfaces on the inner surface of the hood. In one arrangement with a selected emission angle of 60°, the frustoconical surfaces are respectively at angles of order 7.5° and 15° to the central axis of the hood.

To aid in dissipating heat generated by the LEDs the hood can be fabricated from a thermally conductive material that preferably has a thermal conductivity of at least 150 $Wm^{-1}K^{-1}$ and more preferably at least 200 $Wm^{-1}K^{-1}$. In such an arrangement the hood can comprise aluminum, an alloy of aluminum, a magnesium alloy, a metal loaded plastics material or a thermally conductive ceramic material such as aluminum silicon carbide (AlSiC). To further assist in the dissipation of heat from the lamp the hood is preferably in thermal communication with the body such that the hood can assist in radiating heat from the front of the lamp.

Alternatively, the hood can comprise a plastics material such as a polycarbonate or acrylic or a ceramic material which is white in color or which has a light reflective finish such as a metallization layer of for example chromium.

Although the present invention arose in relation to a lamp for a downlight with a selected emission angle of 60° the lamp of the invention can be configured such that selected emission angle is in a range 8° (narrow spot) to 60° (wide flood). For downlighting and general lighting applications the emission angle is typically of order 20°, 30°, 45° or 60°.

Preferably the body is configured such that the lamp can be directly fitted (retrofitted) in an existing lighting fixture. For aesthetic reasons the body can be configured such that it has a form factor that resembles a standard lamp form and is preferably configured to resemble a PAR38, PAR20, PAR30, PAR36, PAR56, PAR64 or Multifaceted Reflector (MR) forms MR16 or MR11. Alternatively, the body is generally cylindrical, generally conical or generally hemispherical in form. The body preferably has a thermal conductivity of at least 150 $Wm^{-1}K^{-1}$ and more preferably at least 200 $Wm^{-1}K^{-1}$ and can comprise aluminum, an alloy of aluminum, a magnesium alloy, a metal loaded plastics material or a thermally conductive ceramic material such as aluminum silicon carbide.

According to a further aspect of the invention a lamp comprises: a) a thermally conductive body; a plurality of LEDs configured as an array and mounted in thermal communication with the body; a light diffuser overlying the array of LEDs; and a light reflective hood overlying the light diffuser, wherein the hood is configured to surround the array of LEDs such that in operation light emitted by the lamp is within a selected emission angle.

In a preferred arrangement the hood comprises at least two contiguous frustoconical light reflective surfaces that surround the array of LEDs.

BRIEF DESCRIPTION OF THE DRAWINGS

In order that the present invention is better understood LED based lamps in accordance with embodiments of the invention will now be described, by way of example only, with reference to the accompanying drawings in which.

DETAILED DESCRIPTION OF THE INVENTION

Figure 1:
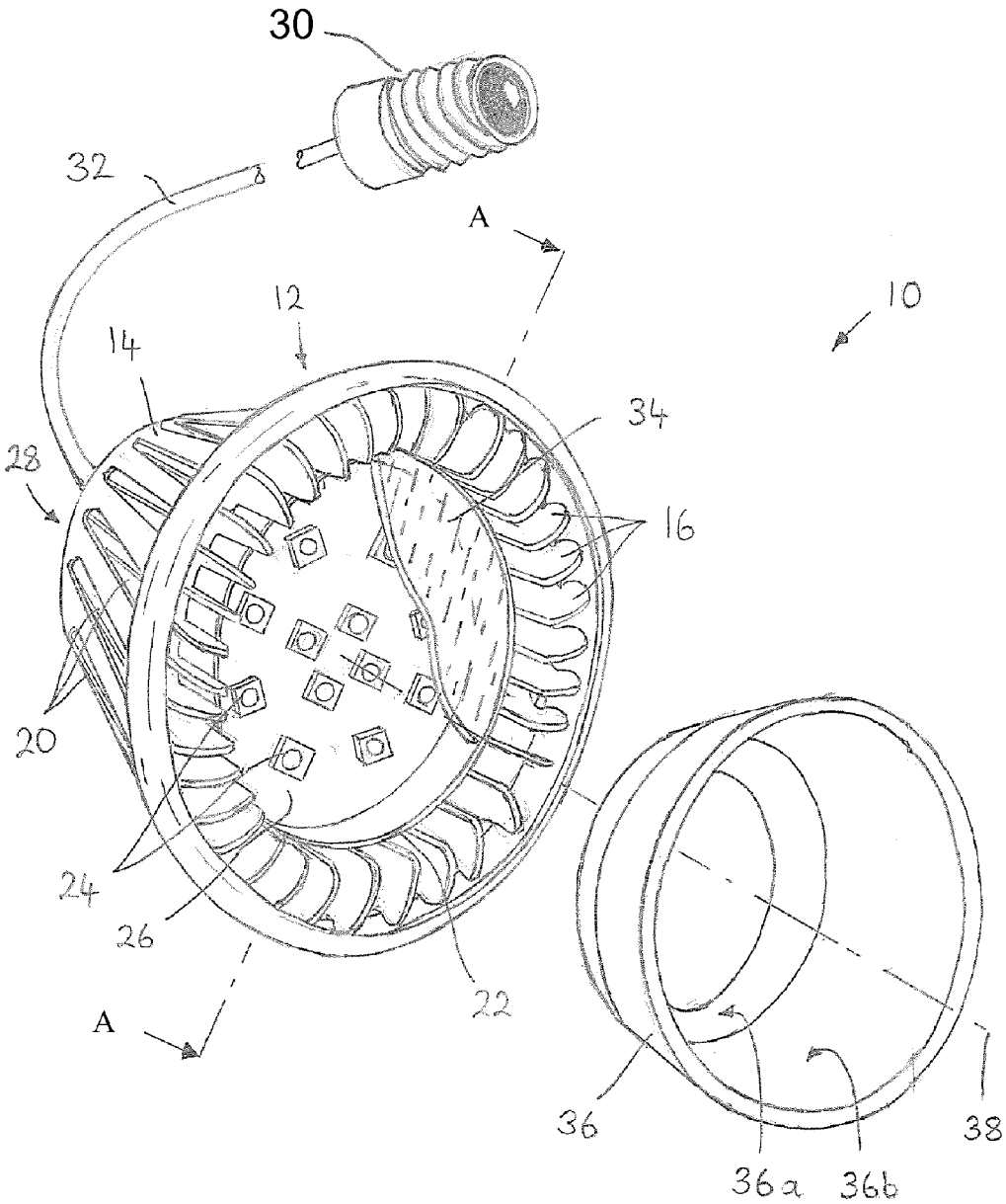
FIG. 1 is a partially exploded perspective view of an LED lamp in accordance with a first embodiment of the invention.

Embodiments of the invention are directed to LED based lamps comprising a light reflective hood located in front of a planar array of LEDs. The hood can comprise at least two substantially frustoconical (frustrum of a cone) light reflective surfaces that surround the array of LEDs and are configured such that in operation light emitted by the lamp is within a selected emission angle (beam spread) and has a variation in illuminance (luminous flux per unit area incident on a surface) below a selected value. Throughout this patent specification like reference numerals are used to denote like parts.

Figure 2:
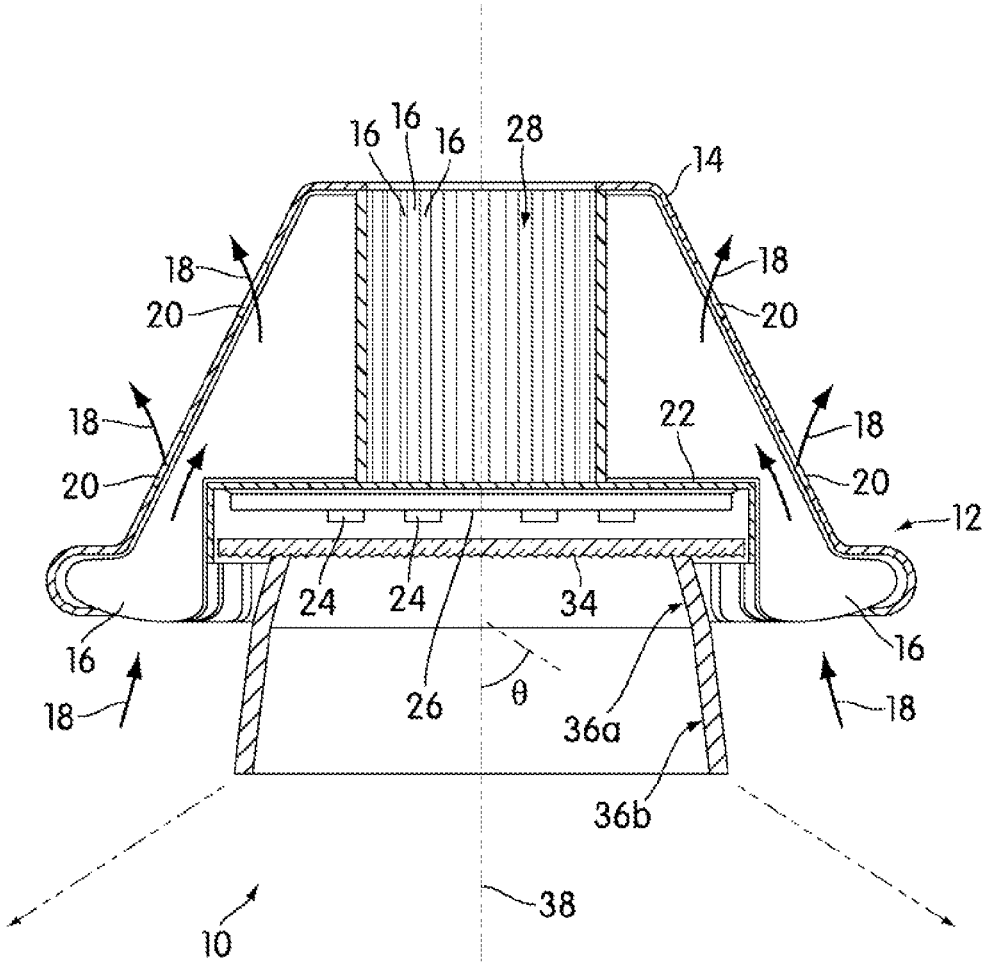
FIG. 2 is a sectional view of the LED lamp through A-A of FIG. 1.

An LED lamp 10 in accordance with a first embodiment of the invention will now be described with reference to FIGS. 1 and 2 in which FIG. 1 is a partially exploded perspective view of the LED lamp and FIG. 2 is a schematic sectional view through A-A of FIG. 1. The LED lamp 10 is configured to generate white light with a Correlated Color Temperature (CCT) of ≈3000° K., an emission intensity of 650-700 lumens and a nominal (selected) beam spread (emission angle θ—angle of divergence measured from a central axis 38) of 60° (wide flood). It is intended to be used as an energy efficient replacement for a PAR38 (Parabolic Aluminized Reflector) halogen lamp as is used in a recessed lighting fixture such as a downlight or a spotlight lighting fixture.

The lamp 10 comprises a generally conical shaped thermally conductive body 12 whose outer surface resembles a frustum of a cone; that is, a cone whose apex (vertex) is truncated by a plane that is parallel to the base (i.e. frustoconical). For aesthetic reasons the form factor of the body 12 is configured to resemble a standard PAR38 (Ø4.75" or Ø12 cm diameter) body shape. Configuring the body such that its form factor resembles a standard form enables the lamp 10 to be retrofitted directly in existing lighting fixtures such as recessed lighting housings (often in the form of a can) that are mounted in suspended (hanging) ceilings, cavity ceilings and cavity walls. The body 12 is fabricated from sheet aluminum and comprises an outer frustoconical shell 14 that houses a plurality of latitudinal radially extending heat radiating fins (veins) 16 that are circumferentially spaced within the outer curved surface of the shell 14. At the front of the body (that is the base of the cone) the fins 16 in conjunction with the shell 14 define a plurality of air inlets configured as an annular array that allows a flow of air 18 (indicated by heavy arrows in FIG. 2) from the front of the body to the rear through slot shaped openings 20 in the outer surface of the shell 14 to increase cooling of the lamp.

A shallow circular thermally conductive tray 22 (also made of aluminum) is mounted within the base of the body 12 and is in direct thermal communication with the fins 16. In operation as illustrated in FIG. 2, and in particular when the unit is used in a recessed ceiling lighting fixture in which the face (base of the cone) is oriented in a downward direction, air 18 is drawn via thermal convection into the body 12 through the air inlets, passes through the body between the fins and is expelled through the openings 20 thereby providing cooling of the fins 16 and hence the tray 22.

A plurality (twelve in the example illustrated) of white light emitting LEDs 24 are mounted as a generally circular array on a circular shaped MCPCB (Metal Core Printed Circuit Board) 26. As is known an MCPCB comprises a layered structure composed of a metal core base, typically aluminum, a thermally conducting/electrically insulating dielectric layer and a copper circuit layer for electrically connecting electrical components in a desired circuit configuration. The metal core base of the MCPCB 26 is mounted in thermal communication with the thermally conductive tray 22 with the aid of a thermally conducting compound such as for example an adhesive containing a standard heat sink compound containing beryllium oxide or aluminum nitride. Rectifier circuitry (not shown) for operating the lamp 10 directly from an alternating current mains power supply can be housed within a cylindrical cavity 28 in the rear of the body.

Each LED 24 preferably comprises a ceramic packaged 1.1 W gallium nitride-based blue emitting LED chip. The LEDs generate blue light with a dominant wavelength in a range 400 nm to 480 nm and typically 455 nm. Since it is required to generate white light each LED further includes one or more phosphor (photo luminescent) materials which absorb a proportion of the blue light emitted by the LED chip and emit yellow, green or red light. The blue light that is not absorbed by the phosphor material(s) combined with light emitted by the phosphor material(s) gives an emission product that appears white in color.

The phosphor material, which is typically in powder form, is mixed with a transparent binder material such as a polymer material (for example a thermally or UV curable silicone or an epoxy material) and the polymer/phosphor mixture applied to the light emitting face of each LED chip. As is known the color and/or CCT of the emission product of the LED is determined by the phosphor material composition, quantity of phosphor material etc. The phosphor material(s)

required to generate a desired color or CCT of white light can comprise any phosphor material(s) in a powder form and can comprise an inorganic or organic phosphor such as for example silicate-based phosphor of a general composition $A_3Si(O,D)_5$ or $A_2Si(O,D)_4$ in which Si is silicon, 0 is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in U.S. Pat. No. 7,575,697 "Europium activated silicate-based green phosphor" (assigned to Internatix Corporation), U.S. Pat. No. 7,601,276 "Two phase silicate-based yellow phosphor" (assigned to Internatix Corporation), U.S. Pat. No. 7,601,276 "Silicate-based orange phosphor" (assigned to Internatix Corporation) and U.S. Pat. No. 7,311,858 "Silicate-based yellow-green phosphor" (assigned to Internatix Corporation). The phosphor can also comprise an aluminate-based material such as is taught in co-pending U.S. Publication No. US2006/0158090 "Aluminate-based green phosphor" (assigned to Internatix Corporation) and U.S. Pat. No. 7,390,437 "Aluminate-based blue phosphor" (assigned to Internatix Corporation), an aluminum-silicate phosphor as taught in co-pending U.S. Publication No. US2008/0111472 "Aluminum-silicate orange-red phosphor" or a nitride-based red phosphor material such as is taught in co-pending U.S. application Ser. No. 12/632,550 filed Dec. 7, 2009 (assigned to Internatix Corporation). It will be appreciated that the phosphor material is not limited to the examples described herein and can comprise any phosphor material including nitride and/or sulfate phosphor materials, oxy-nitrides and oxy-sulfate phosphors or garnet materials (YAG).

The lamp 10 can further comprise an E26 connector cap 30 (Edison screw lamp base) enabling the device to be directly connected to a mains power supply using a standard electrical lighting fixture (not shown). It will be appreciated that depending on the intended application other connector caps can be used such as, for example, a double contact bayonet connector (i.e. B22d or BC) as is commonly used in the United Kingdom, Ireland, Australia, New Zealand and various parts of the British Commonwealth or an E27 screw base (Edison screw lamp base) as used in Europe. As shown the connector cap can be connected to the lamp by a cable 32. Alternatively the connector cap 30 can be mounted to the body 12 such as for example mounted to the truncated apex of the body.

The lamp further comprises a light diffuser 34 which is mounted to the front of the tray 22 and which is operable to diffuse light emitted from the LEDs. For ease of understanding the light diffuser 34 is shown as partially cut away in FIG. 1. Typically the light diffuser comprises a light transmissive (transparent) window for example a polymer material such as a polycarbonate or acrylic that has a surface topology such as micro-patterning of one or both faces. As is known the patterning can be in the form of parallel straight line grooves, other 2D patterns or a pattern of 3D features such as an array of cone shaped features. In other arrangements it is envisaged that the light diffuser 34 comprise a light transmissive plastics material such as a polycarbonate or an acrylic which incorporates light scattering particles distributed throughout its volume.

In accordance with the invention the lamp 10 further comprises a light reflective hood (reflector) 36 which is configured to i) define the selected emission angle (beam spread) of the lamp (i.e. 60° in this example) and ii) to make the illuminance (luminous flux per unit area) more uniform over a greater proportion of the total emission angle. The hood 36 is similar in form to a camera lens hood and comprises a generally cylindrical shell with two contiguous (conjoint) inner light reflective frustoconical surfaces 36*a* and 36*b*. The first inner light reflective surface 36*a* is inclined at an angle of approximately 7.5° to the central axis 38 of hood whilst the second light reflective frustoconical surface 36*b* is inclined at approximately 15° to the central axis. The ratio of heights of the first to second reflective surface in an axial direction is approximately 1:2 (e.g. 1 cm: 2 cm). The hood is preferably fabricated from a material with a good thermal conductivity (i.e. typically at least 150 $Wm^{-1}K^{-1}$ and preferably at least 200 $Wm^{-1}K^{-1}$) such as aluminum or an aluminum alloy. Such a hood can aid in dissipating heat from the front of the lamp by radiating heat from its surfaces. To further aid in the dissipation of heat the hood can be thermally coupled to the body (not shown) such that the hood additionally acts as a heat radiating element. Preferably the outer surface of the hood is treated (e.g. anodized) or coated with a black material to increase heat radiation from the hood.

Alternatively, the hood can be fabricated from a polymer material such as a polycarbonate or acrylic or a ceramic material which is white in color or which has a light reflective finish such as a metallization layer of chromium or aluminum applied to the inner light reflective surfaces.

Figure 3:
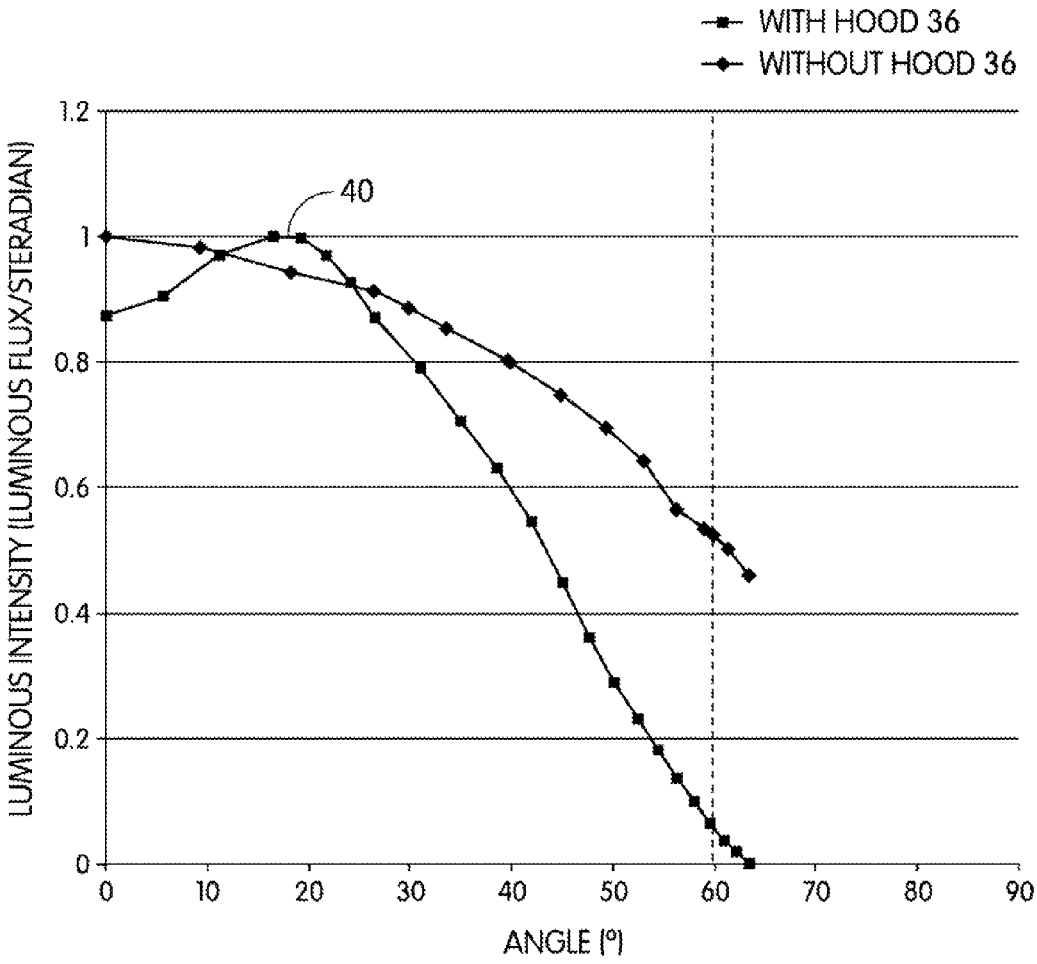
FIG. 3 is a plot of angular distribution of emitted luminous intensity for an LED lamp in accordance with the invention.
Figure 4:
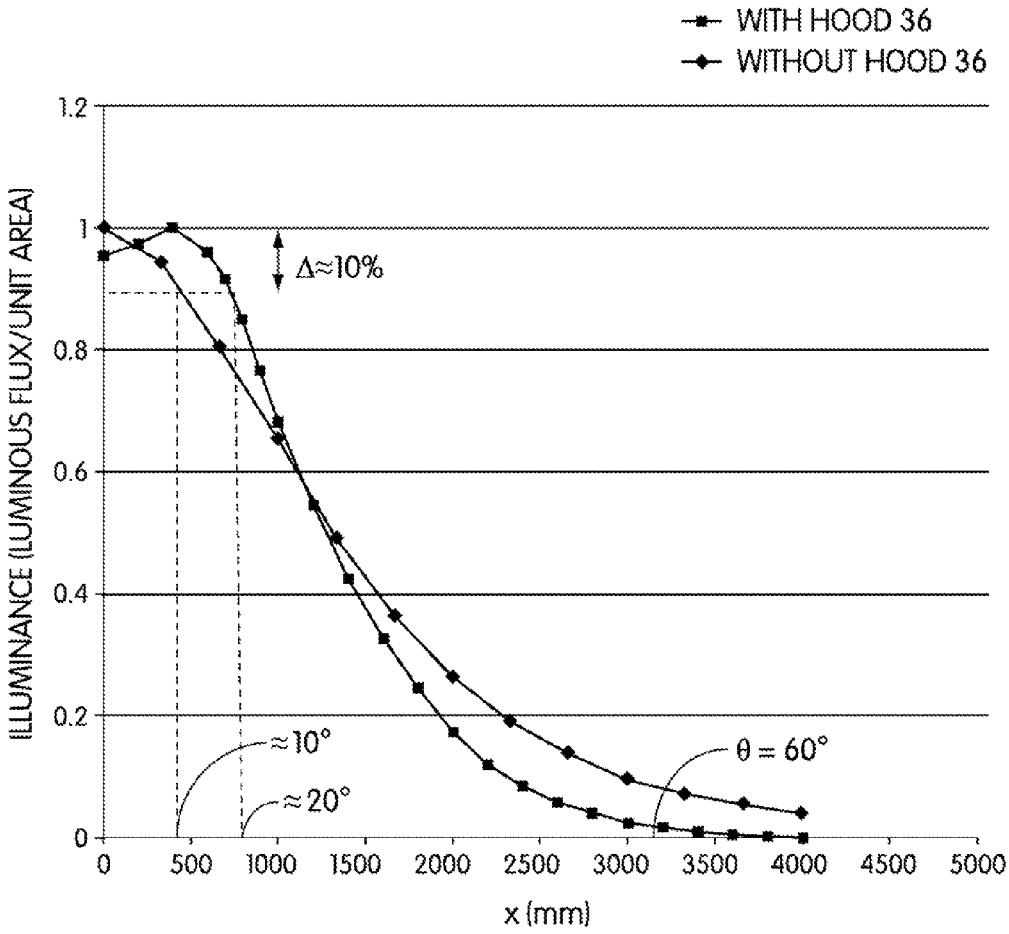
FIG. 4 is a plot of illuminance versus distance off axis for an LED lamp in accordance with the invention.

The hood 36 is dimensioned and positioned such that each of the LEDs 24 is contained within its opening (aperture). The geometry of the hood is configured such that the lamp 10 produces a light emission within a selected emission angle and takes into account among other factors the emission profile of the LEDs and the distance from the LEDs to the hood. For a light source whose luminous intensity (luminous flux (power) per steradian (lm/sr)) is substantially constant with angle from a central axis, the source's illuminance (i.e. luminous flux per unit area ($lm/m^2$) incident on a surface) will decrease with angular deviation since the same luminous intensity (i.e. luminous flux per steradian) will be incident on an annulus of increasingly greater area. In the lamp of the invention and to compensate at least in part for the decrease in illuminance with angular deviation, the frustoconical light reflective surfaces 36*a*, 36*b* are configured such as to direct a proportion of light away from the axis 38 of the lamp and to thereby result in the illuminance being substantially constant over a larger proportion of the selected emission angle θ. FIG. 3 are plots of angular distribution of luminous intensity (luminous intensity versus angle) for a lamp (θ=60°) in accordance with the invention with (■) and without (◆) the hood 36. FIG. 4 are plots of illuminance (luminous flux per unit area for light incident on a surface (measuring plane) located two meters (78 inches) from the front edge of the hood) versus distance from the central axis 38 for a lamp (θ=60°) in accordance with the invention with (■) and without (◆) the hood 36. The luminous intensity and illuminance values are normalized such that the maximum values of each are respectively one. As can be seen from FIG. 3 the light reflective hood 36 has the effect of shifting the angle at which the maximum luminous intensity 40 occurs from the central axis 38 to an angle of approximately 18° off axis. As shown in FIG. 4 the result of directing light away from the central axis this results in a variation Δ in illuminance of 10% or less over an angle of 20°; that is the illuminance is substantially constant over a third of the total selected emission angle θ. As can be seen the same lamp without the light reflective hood 36 typically has a variation in illuminance of order 10% over an angular variation of 10°. The hood 36 thus has the effect that the illuminance of light incident on a surface is substantially constant over a larger proportion of the selected emission angle θ. It is envisaged that by appropriate configuration of the hood a variation in illuminance of 10% or less should be achievable over approximately 50% (i.e. 30° for 0=60) of the total selected emission angle θ.

TABLE 1 gives values for zonal (angular) luminous flux in terms of the percentage proportion (%) of total luminous flux within an angular zone. As can be seen from the table over 98% (nearly 99%) of the total luminous flux is emitted within the selected (nominal) emission angle θ of the lamp. By way of comparison existing LED based lamps emit of order 85-90% of their total luminous flux (power) within their nominal emission angle (beam spread).

TABLE 1

Zonal lumen emission for a 60° beam spread LED lamp in accordance with the invention

| Angular zone | Proportion of total light emission (%) |
|---|---|
| 0°-30° | 33.9 |
| 0°-40° | 59.6 |
| 0°-60° | 98.8 |
| 0°-90° | 100 |

Figure 5:
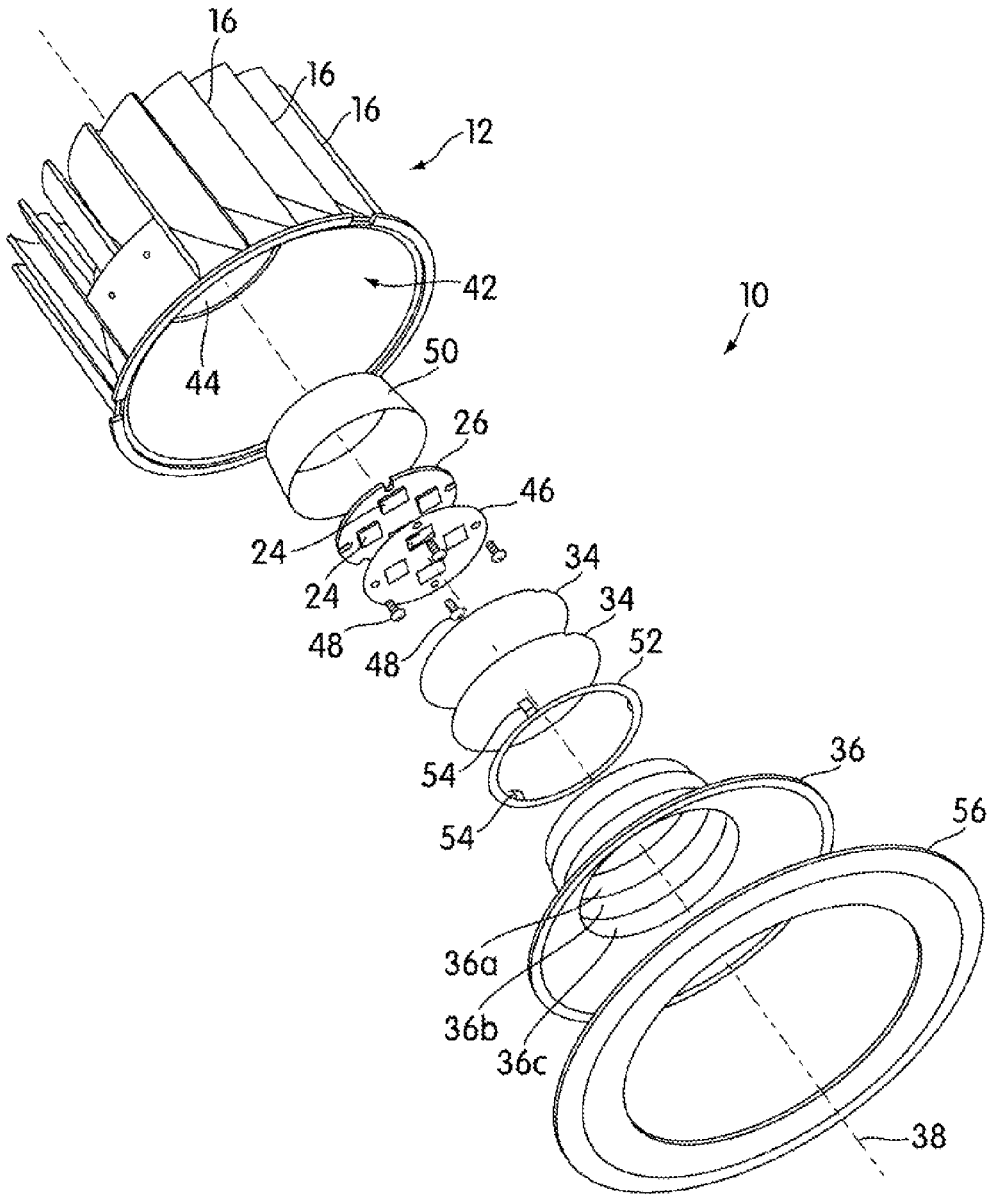
FIG. 5 is an exploded perspective view of an LED lamp in accordance with a further embodiment of the invention.
Figure 7:
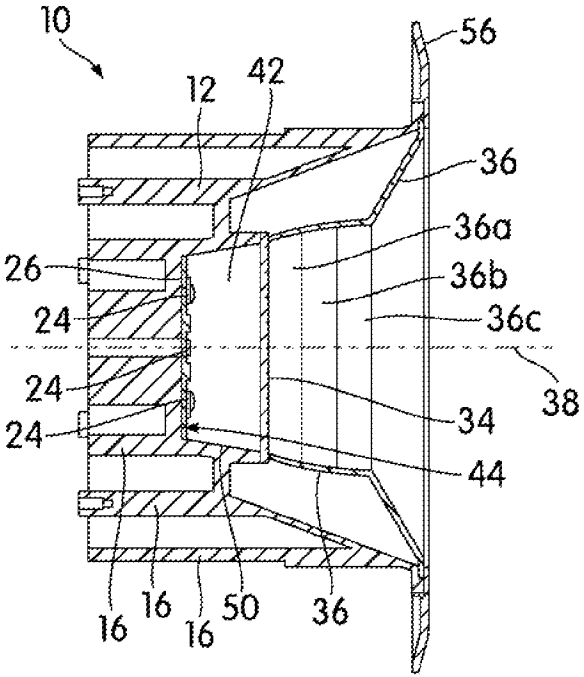
FIG. 7 is a sectional view of the LED lamp through A-A of FIG. 6.
Figure 6:
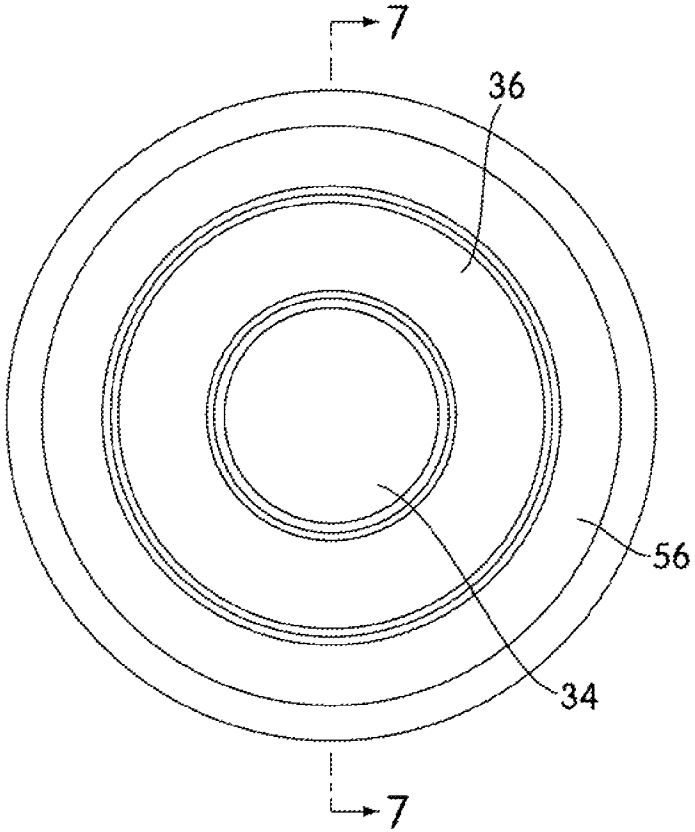
FIG. 6 is an end view of the lamp of FIG. 5.

An LED lamp 10 in accordance with a further embodiment of the invention is now described with reference to FIGS. 5, 6 and 7 in which FIG. 5 is an exploded perspective view of the LED lamp, FIG. 6 is an end view of the lamp and FIG. 7 is a sectional view through A-A of FIG. 6. The LED lamp 10 is configured to generate white light with a CCT≈3000° K., an emission intensity of 600 lumens and a selected emission angle θ≈50° (angle of divergence measured from the central axis 38). It is intended to be used as an energy efficient replacement for a 6 inch down light.

In this embodiment the thermally conductive body 12 is generally cylindrical in shape and fabricated from die cast aluminum. The body 12 has a series of latitudinal spirally extending heat radiating fins 16 towards the base of the body and a generally frustoconical axial chamber 42 that extends from the front of the body a depth of approximately two thirds of the length of the body. The form factor of the body 12 is configured to enable the lamp to retrofitted directly in a standard six inch down lighting fixture (can) as are commonly used in the United States. In this embodiment there are no air inlets and the body 12 functions as a heat sink. To increase heat radiation from the lamp 10 and thereby increase cooling of the LEDs 24, the outer surface of the body can be treated or painted black.

Four white light emitting LEDs 24 are mounted as a square array on a circular shaped MCPCB 26. With the aid of a thermally conducting compound the metal core base of the MCPCB 26 is mounted in thermal communication with the body via the floor 44 of the chamber 42. Each LED 24 preferably comprises a 3 W ceramic packaged array of gallium nitride-based blue emitting LED chips. To maximize the emission of light, the lamp can further comprise a light reflective circuit mask 46 that covers the MCPCB and includes apertures corresponding to the LEDs 24. The circuit mask 44 can comprise a thin sheet of light reflective polymer material that is white or has a white finish. As shown in FIG. 5 the MCPCB 26 and circuit mask 46 can be mechanically fixed to the body 12 by one or more screws, bolts or other fasteners 48.

The lamp 10 further comprises a hollow generally cylindrical chamber wall mask 50 that surrounds the array of LEDs 24. The chamber wall mask 50 can be made of a plastics material and preferably has a white or other light reflective finish.

The light diffuser 34 is mounted overlying the front of the chamber wall mask 50 using an annular steel clip 52 that has resiliently deformable barbs 52 that engage in corresponding apertures in the body 12. As shown in FIG. 5 the diffuser 34 can additionally include a clear (light transmissive) window.

In accordance with the invention the lamp 10 further comprises a light reflective hood 36 which is configured to i) define the selected emission angle θ of the lamp (i.e. 50° in this example) and ii) to make the illuminance more uniform over a greater proportion of the emission angle. The hood 36 comprises a generally cylindrical shell with three contiguous (conjoint) inner light reflective frustoconical surfaces 36*a*, 36*b* and 36*c*. The hood 36 is preferably made of Acrylonitrile butadiene styrene (ABS) with a metallization layer. Finally the lamp 10 can comprise an annular trim (bezel) 56 that can also be fabricated from ABS.

The operation of the lamp of FIGS. 5, 6 and 7 is identical to that of the lamp of FIGS. 1 and 2 and is not described further.

The lamp of the invention is not restricted to the specific embodiment described and variations can be made that are within the scope of the invention. For example, lamps in accordance with the invention can comprise other LED chips such as silicon carbide (SiC), zinc selenide (ZnSe), indium gallium nitride (InGaN), aluminum nitride (AlN) or aluminum gallium nitride (AlGaN) based LED chips that emit blue or U.V. light.

Although the present invention arose in relation to an LED lamp for a downlight with an emission angle of 60° it is envisaged in other embodiments to configure the hood such that the lamp has a selected emission angle in a range 8° (narrow spot) to 60° (wide flood). Typically for downlighting and general lighting applications the emission angle is of order 20°, 30°, 45° or 60°.

Moreover it is also envisaged that the light diffuser can comprise a lens structure such as a Fresnel-type lens that is configured to direct the light emission in a particular direction. In such an arrangement the lens structure is configured in conjunction with the hood such as to give a more uniform illuminance of emitted light.

Depending on the intended application the form factor of the body can be configured to resemble other standard forms including PAR20 (Ø2.5" or Ø6.5 cm), PAR30 (Ø3.75" or Ø9.5 cm), PAR36 (Ø4.5" or Ø11.5 cm), PAR56 (Ø7" or Ø17.5 cm), PAR64 (Ø8" or Ø20 cm), MR16 (Multifaceted Reflector Ø2" or Ø50 mm) and MR11 (Ø1.5" or Ø40 mm). As well as for aesthetic reasons such a form enables the lamp to be retrofitted in standard existing lighting fixtures. Alternatively, the body can have a non-standard form factor and be configured such that the lamp can be retrofitted in standard lighting fixtures. Examples of such geometries can include for example a thermally conductive body that is generally cylindrical or generally hemispherical depending on an intended application. Moreover, the body can be solid in form such as a die-cast construction be fabricated from an alloy of aluminum, a magnesium allow, a metal loaded plastics material or a thermally conductive ceramic material such as aluminum silicon carbide (AlSiC). Preferably the body includes a plurality of heat radiating fins to aid in dissipating heat from the lamp.

Whilst the invention arose in an endeavor to provide an improved lamp for a recessed lighting fixture the lamp of the invention can be used in other applications such as for example surface mountable fixtures or spotlights.

What is claimed is:

1. A lamp comprising:

a thermally conductive body;

a plurality of light emitting diodes configured as an array and mounted in thermal communication with the body; and a light reflective hood located in front of the plane of light emitting diodes, wherein the hood has at least two frustoconical light reflective surfaces that surround the array of light emitting diodes and are configured such that in operation light emitted by the lamp is within a selected emission angle;

wherein a diameter of a first frustoconical light reflective surface is smaller than a diameter of a second frustoconical light reflective surface more distal to the light emitting diodes than the first frustoconical light reflective surface.

2. The lamp according to claim 1, wherein the at least two light reflective surfaces are contiguous.

3. The lamp according to claim 1, wherein the hood is configured such that in operation a variation in illuminance is 10% or less over approximately a third of the selected emission angle.

4. The lamp according to claim 1, wherein the hood is configured such that in operation a variation in illuminance is 10% or less over approximately half of the selected emission angle.

5. The lamp according to claim 1, wherein the hood is configured such that in operation a proportion of total light emission emitted within the selected emission angle is selected from the group consisting of: at least 90%, at least 95% and at least 98%.

6. The lamp according to claim 1, and further comprising a light diffuser interposed between the array of light emitting diodes and the hood.

7. The lamp according to claim 1, wherein the hood is generally cylindrical in form.

8. The lamp according to claim 1, wherein the hood comprises a thermally conductive material.

9. The lamp according to claim 8, wherein the hood has a thermal conductivity selected from the group consisting of at least 150 $Wm^{-1}K^{-1}$ and at least 200 $Wm^{-1}K^{-1}$.

10. The lamp according to claim 8, wherein the hood is in thermal communication with the thermally conductive body.

11. The lamp according to claim 1, wherein the hood comprises a material selected from the group consisting of: aluminum, an alloy of aluminum, a magnesium alloy, a plastics material, a metal loaded plastics material and a thermally conductive ceramic material.

12. The lamp according to claim 1, and further comprising a light reflective material applied to the at least two light reflective surfaces.

13. The lamp according to claim 1, wherein the selected emission angle is in a range 8° to 60°.

14. The lamp according to claim 13, wherein the selected emission angle is selected from the group consisting of being of order: 20°, 30°, 45° and 60°.

15. The lamp according to claim 1, wherein the body is configured such that the lamp can be fitted in an existing lighting fixture.

16. The lamp according to claim 1, wherein the form of the body is selected from the group consisting of being: generally cylindrical, generally conical and generally hemispherical in form.

17. The lamp according to claim 1, wherein the body is configured such that it has a form factor that resembles a standard form selected from the group consisting of: PAR38, PAR20, PAR30, PAR36, PAR56, PAR64, MR16 and MR11.

18. The lamp according to claim 1, wherein the body comprises a material selected from the group consisting of: aluminum, an alloy of aluminum, a magnesium alloy, a plastics material, a metal loaded plastics material, a thermally conductive ceramic material and aluminum silicon carbide.

19. A lamp comprising:

a thermally conductive body;

a plurality of light emitting diodes configured as an array and mounted in thermal communication with the body;

a light diffuser overlying the array of light emitting diodes; and a light reflective hood overlying the light diffuser, wherein the hood is configured to surround the array of light emitting diodes such that in operation light emitted by the lamp is within a selected emission angle, and wherein a diameter of the hood is smaller at a first end proximal to the light emitting diodes than at a second end more distal to the light emitting diodes than the first end.

20. The lamp according to claim 19, wherein the hood is configured such that a variation in illuminance is 10% or less over approximately a third of the selected emission angle.

21. The lamp according to claim 1, wherein the hood is configured such that a variation in illuminance is 10% or less over approximately half of the selected emission angle.

22. The lamp according to claim 19, wherein the hood is configured such that in operation a proportion of total light emission emitted within the selected emission angle is selected from the group consisting of: at least 90%, at least 95% and at least 98%.

23. The lamp according to claim 19, wherein the hood comprises at least two frustoconical light reflective surfaces that surround the array of light emitting diodes.

24. The lamp according to claim 23, wherein the light reflective surfaces are contiguous.

25. The lamp according to claim 19, wherein the emission angle is in a range 8° to 60°.

* * * * *